US006443131B1

(12) United States Patent
Bueser

(10) Patent No.: US 6,443,131 B1
(45) Date of Patent: Sep. 3, 2002

(54) FLAT PIPE PRESSURE DAMPER FOR DAMPING OSCILLATIONS IN LIQUID PRESSURE IN PIPES CARRYING LIQUIDS

(75) Inventor: Wolfgang Bueser, Freiberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/600,839

(22) PCT Filed: May 26, 1999

(86) PCT No.: PCT/DE99/01544

§ 371 (c)(1),
(2), (4) Date: Aug. 25, 2000

(87) PCT Pub. No.: WO00/32924

PCT Pub. Date: Jun. 8, 2000

(30) Foreign Application Priority Data

Nov. 26, 1998 (DE) ..... 198 54 551

(51) Int. Cl.[7] ..... F02M 37/04
(52) U.S. Cl. ..... 123/467; 123/456
(58) Field of Search ..... 123/467, 447, 123/456; 138/26, 28, 30

(56) References Cited

U.S. PATENT DOCUMENTS

| | | | | | |
|---|---|---|---|---|---|
| 3,665,967 | A | * | 5/1972 | Kachnik | 138/137 |
| 3,677,299 | A | * | 7/1972 | Cibie | 138/26 |
| 4,056,679 | A | * | 11/1977 | Brandt et al. | 174/13 |
| 4,553,744 | A | * | 11/1985 | Konishi et al. | 267/140.13 |
| 4,649,884 | A | * | 3/1987 | Tuckey | 123/457 |
| 4,897,906 | A | * | 2/1990 | Bartholomew | 29/890.09 |
| 5,038,828 | A | * | 8/1991 | Fonser et al. | 138/30 |
| 5,575,262 | A | * | 11/1996 | Rohde | 123/467 |
| 5,617,827 | A | * | 4/1997 | Eshleman et al. | 123/456 |
| 5,896,843 | A | * | 4/1999 | Lorraine | 123/467 |

* cited by examiner

*Primary Examiner*—Carl S. Miller
(74) *Attorney, Agent, or Firm*—Ronald E. Greigg

(57) ABSTRACT

The invention relates to a flat pipe pressure damper for damping fluid pressure pulsations in fluid lines, in particular fuel pressure pulsations in fuel supply lines of motor vehicles, having at least one chamber, of which at least a part of the chamber wall, in operative connection with the fluid, can be elastically deformed by the fluid pressure pulsations. The invention makes the provision that a part of the chamber is filled with a fluid.

13 Claims, 3 Drawing Sheets

FLAT PIPE PRESSURE DAMPER FOR DAMPING OSCILLATIONS IN LIQUID PRESSURE IN PIPES CARRYING LIQUIDS

PRIOR ART

The invention is based on a flat pipe pressure damper for damping fluid pressure pulsations in fluid lines and a fuel supply line for a vehicle.

This kind of flat pipe pressure damper and fuel supply line have been disclosed by EP 0 235 394 A1. The known flat pipe pressure damper is integrated into the fuel supply line of an internal combustion engine. The fuel supply line is divided in its longitudinal direction into an upper, air-filled chamber and a lower, fuel-carrying chamber by an elastic membrane. The flat pipe pressure damper in this case is constituted by the upper, air-filled chamber and the elastic, fuel-tight membrane. The membrane absorbs pressure surges caused by switching pulsations of injection valves and feed pulsations of an injection pump in the lower, fuel-carrying chamber by the fact that this membrane elastically deforms and thereby transmits the pressure pulsations into the air cushion in the upper, air-filled chamber. Through the elastic deformation of the membrane and the resulting compression of the air cushion in the upper, air-filled chamber, oscillation energy is lost, by means of which the pressure pulsations in the lower, fuel-carrying chamber are damped.

The membrane is clamped between an upper part and a lower part of the line wall of the fuel supply line, wherein the edge of the upper part of the line wall is overlapped by the edge of the lower part of the line wall. In addition, an O-ring is inserted between the upper and lower parts of the line wall to create a seal.

The known flat pipe pressure damper has the disadvantage that the upper, air-filled chamber can collapse when there are intense pressure surges of the kind that occur during leak tests, for example. Since the oscillatory membrane is frictionally secured between the upper and lower line wall, the membrane can slip out of its seat when under high stress. A repair is costly since the fuel line involved must be disassembled and a new membrane must be inserted.

Furthermore, the wall thickness of the oscillatory membrane must be adapted to the respective pressure range in which the flat pipe pressure damper is to be used so that a large number of different flat pipe pressure dampers must be produced, which results in correspondingly high manufacturing costs.

ADVANTAGES OF THE INVENTION

The flat pipe pressure damper for damping fluid pressure pulsations according to the invention has an advantage over the prior art that the percentage of non-compressible fluid in the chamber prevents chamber from collapsing when there are intense pressure surges. Since the oscillatory and damping properties of the flat pipe pressure damper according to the invention can be preset as a function of the fluid quantity disposed in the chamber, it is no longer necessary to produce dampers with to different chamber wall thicknesses. As a result, the same flat pipe pressure damper can be used universally for different pressure ranges. Moreover, a selection can be made from among the wall thicknesses being considered for the flat pipe pressure damper, which is the most favorable for manufacturing.

Other advantages arise from the high safety reserves of the flat pipe pressure damper according to the invention so that flat pipe pressure damper is also not damaged by leak tests in which the testing pressures are up to twice the normal operating pressure.

Advantageous improvements and updates of the flat pipe pressure damper disclosed are possible by means of the measures taken hereinafter.

A particularly preferable improvement of the invention provides that one part of the chamber is preferably filled with oil and the other part of the chamber is filled with a gaseous medium, preferably with air at atmospheric pressure. On the one hand, the chamber can produce a favorable damping effect due to the high volumetric elasticity of air. On the other hand, oil has a very low compressibility, as a result of which there is a high degree of protection against a collapsing of the chamber when the elasticity reserves are exceeded.

The apparatus of the flat pipe pressure damper has the advantage that if the pressure damper develops an undesirable leak, no fluid escapes from the fluid line.

BRIEF DESCRIPTION OF THE DRAWINGS

Exemplary embodiments of the invention are shown in the drawings and will be explained in detail in the subsequent description.

DESCRIPTION OF THE EXEMPLARY EMBODIMENTS

A flat pipe pressure damper 1 for damping fluid pressure pulsations in fluid lines, in particular fuel pressure pulsations in fuel supply lines of motor vehicles is set forth.

Figure 1:
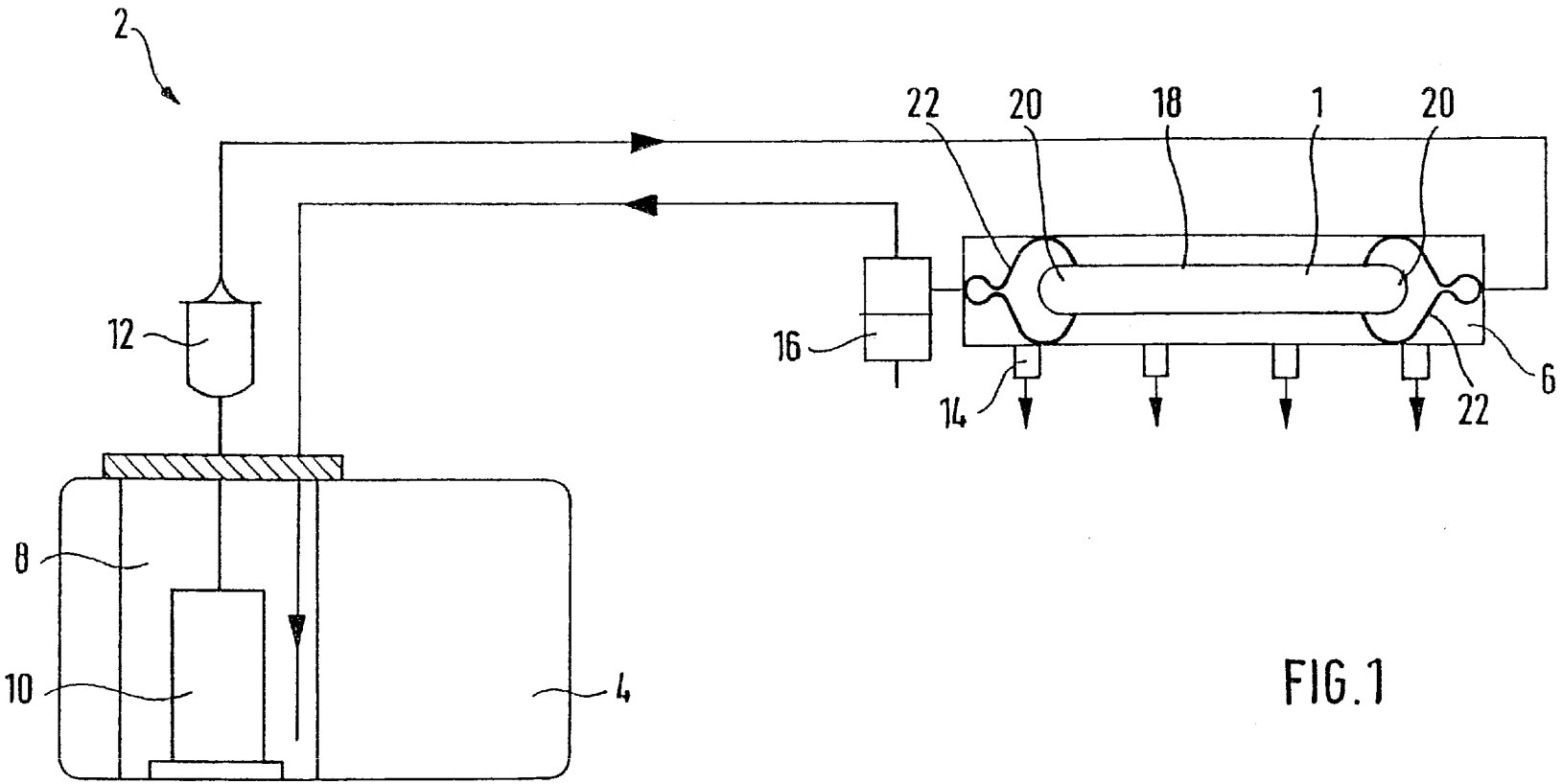
FIG. 1 shows a schematic representation of a fuel supply device with a preferred embodiment of a flat pipe pressure damper according to the invention.

In a simplified, schematic form, FIG. 1 depicts a fuel supply device 2 in which fuel is supplied from a tank 4 to a tubular fuel distributor 6 of an internal combustion engine not otherwise shown. To this end, a tank insert unit 8 with a fuel pump 10 is disposed in the tank 4. The fuel pump 10 and the fuel distributor 6 have a fuel filter 12 disposed between them. In the fuel distributor 6, fuel is distributed to injection valves 14 in a known fashion. The fuel is supplied at one end of the fuel distributor 6 while at the other end, fuel that has not been injected is conveyed backed 10 the tank 4 via a pressure regulator 16. Alternatively, the fuel supply device 2 can also be embodied without a return and in such a case, the pressure regulator 16 is disposed in the tank insert unit 8 and the atmospheric pressure is used as a reference pressure. the flat pipe pressure damper 1 according to the invention is embodied as a flat pipe 18 inside the fuel distribute; 18 and is disposed, for example, horizontally, wherein the two ends 20 of the flat pipe 18 are closed, for example in a tapering fashion, and are grasped by means of clamps 22 fastened to the ends of the fuel distributor 6 so that the flat pipe pressure damper 1 is secured spaced radially and axially apart from the inner wall of the fuel distributor 6 and is in essence completely encompassed by fuel.

Figure 2:
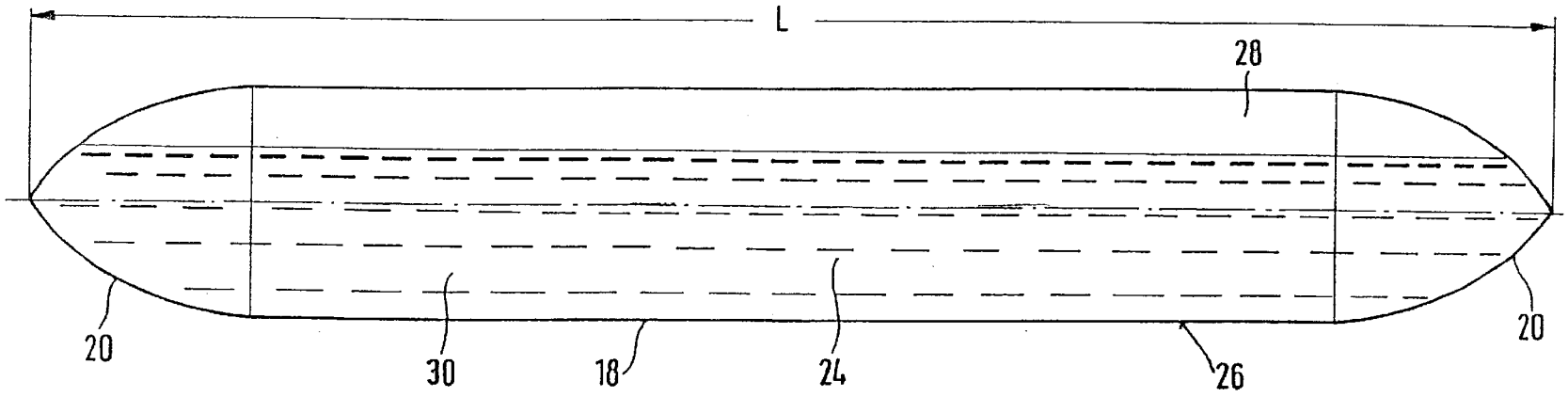
FIG. 2 shows a sectional side view of the flat pipe pressure damper from FIG. 1, FIG. 3 has a cross-sectional front view of the flat pipe pressure damper from FIG. 2.
Figure 3:
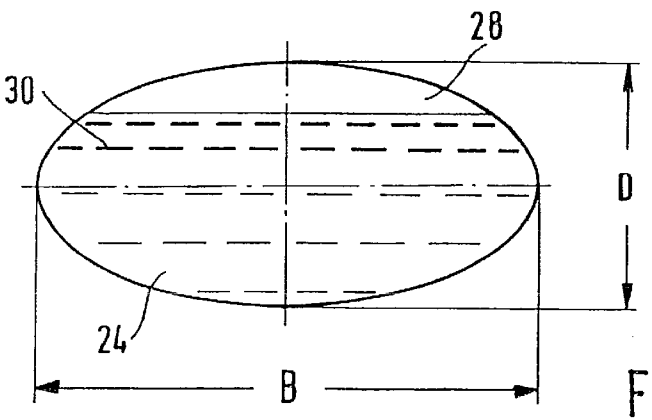

According to the detail from FIG. 1 that is shown in enlarged fashion in FIG. 2, the flat pipe 18 is comprised, for 12 example, of plate steel with an essentially elliptical cross section. The cross section can, however, also have a round, polygonal, or other form. The flat pipe 18 that is shown by way of example is characterized by the length L, the thickness D, the width B, and the wall thickness a; for example, L=285 mm, D=5.15 mm, B=14.5 mm, and a=0.2 mm. The ends 20 of the flat pipe 18 are closed and taper, for example, in its longitudinal direction, which produces a self-contained chamber 24. The thickness and width or the cross section of the chamber 24 are preferably small in relation to its length. As a result of the low wall thickness, the chamber wall 26 can be deformed in a resilient fashion when fuel pressure pulsations in the fuel distributor 6 that are caused by switching pulsations of the injection valves 14 act on it from the outside. Oscillation energy is thereby taken out of the system which leads to the desired damping of fuel pressure pulsations. Due to the preferably elongated form of the chamber 24, it mainly deforms in the radial direction when subjected to pressure.

According to the preferred embodiment of the flat pipe pressure damper 1, the chamber wall 26 is of one piece and has the same wall thickness over its entirety. Alternatively, however, only a part of the chamber wall 26 could elastically deform while the other part would remain quasi-rigid, which could be achieved, for example, by varying wall thicknesses in different sections of the chamber wall 26 or by using different materials in different sections of this wall.

According to the invention, the chamber 24 is filled with a gaseous medium, preferably with air 28, and with a fluid medium, preferably with oil 30, so that the chamber 24 cannot collapse in the event of intense pressure surges. The material is (E module) and the geometry of the material 24 as well as its fill level of air 28 and oil 30 here are dimensioned so that at pressures of up to twice the operating pressure, only purely elastic deformations occur and not plastic ones. Preferably, the fill level is 88% to 92% oil, i.e. 88% to 92% of the chamber volume is filled with oil 30 and the rest is preferably filled with air 28 at atmospheric pressure. Alternatively, the chamber 24 can also be filled with a different gas at atmospheric pressure or at a different pressure and can also be filled with a different fluid medium.

Figure 4:
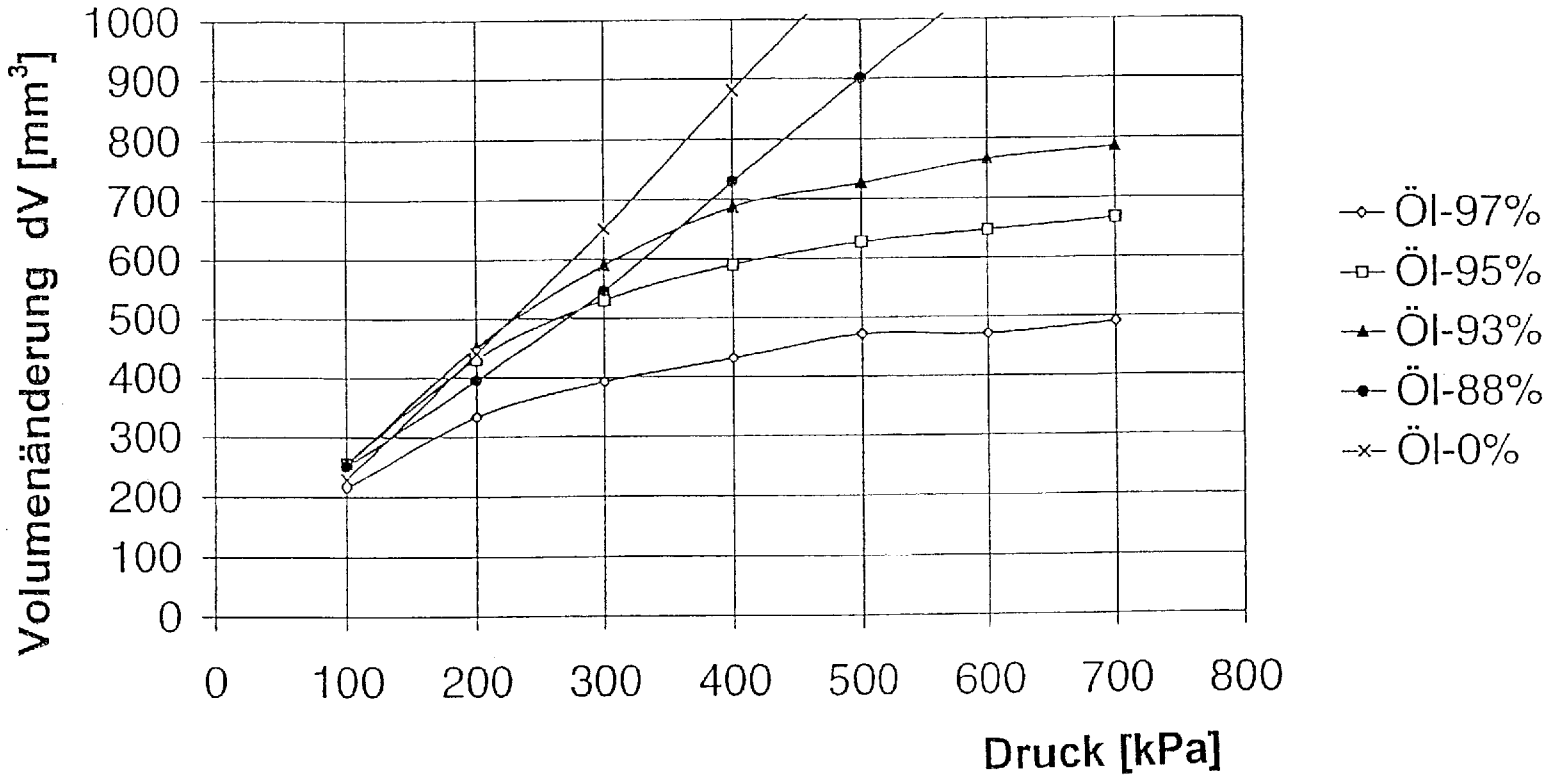
FIG. 4 shows a diagram for the volume change of the flat pipe pressure damper from FIGS. 2 and 3, as a function of the external pressure.

FIG. 4 shows experimentally determined values for the volume change dV of a flat pipe pressure damper 1 according to the invention with a flat pipe that has a length L=285 mm, a thickness D=5.15, a width B=14.5 mm, and a wall thickness a=0.2 mm, as a function of the external pressure for different fill levels of oil. It follows from this that when filled with only air (oil=0%, internal pressure $p_0$=1 bar), as external pressure increases, an approximately linear volume change dV of the chamber 24 takes place, as would be expected. With a further increase in the external pressure, the chamber wall 26 would plastically deform and finally collapse, which is not shown in the diagram, however, for reasons of scale. In contrast, a higher fill level of 97% oil results in a chamber structure with a relatively low resilience in the range from 100 to approximately 500 kPa, while at even higher external pressures, almost no additional deformation occurs, as demonstrated by the sharply degressive curve. A chamber 24 of this kind behaves in a very rigid manner due to the high percentage of non-compressible fluid, which is why the damping action is relatively slight.

As can also be seen in FIG. 4, fill levels of 88% to 95% result in a slightly degressive behavior with an almost linear volume change dV at low pressures, which then increases only slightly at higher pressures. There is then an approximately polytropic change of state, i.e. with the equation $p \cdot V^n$=const, where p is the pressure, V is the volume, and n is the polytropic exponent. Preferably, the fill level of oil 30 in a chamber 24 of the above-indicated size lies between 88% and 92%. In this range, the desired volume change behavior takes place in which due to a sufficient elasticity, there is a favorable damping action at low pressures and due to an increasing rigidification at higher pressures, there is a simultaneous protection against collapses and plastic deformations of the chamber 24. The limit values for the fill level of oil 30 at which the desired volume change behavior of the chamber 24 can still be achieved depend, among other things, on the material rigidity and inherent stability of the chamber 24 and the type of gaseous and fluid medium so that the above-indicated limit values only apply to the preferred embodiment.

With a given material rigidity and inherent stability, the elasticity and damping properties of the chamber 24 can therefore be adapted to respectively existing pressure pulsations in the fuel distributor 6 in a simple manner as a function of the type of gaseous and fluid medium and their fill levels.

The use of the flat pipe pressure damper 1 according to the invention is not limited to fuel-carrying lines, but can be used to damp pressure pulsations in any type of fluid line. In the exemplary embodiment according to FIG. 1, a description is given for the use of the flat pipe pressure damper 1 in a fuel injection system of a mixture compressing internal combustion engine with externally supplied ignition.

The foregoing relates to a preferred exemplary of embodiments of the invention, it being understood that other variants and embodiments thereof are possible within the spirit and scope of the invention, the latter being defined by the appended claims.

I claim:

1. A flat pipe pressure damper (1) for damping fluid pressure pulsations in a tubular fuel distributor (6) of a fuel supply for a motor vehicle, comprising at least one elastically deformable chamber (24) within the fuel distributor (6) which is in operative connection with the fuel, a part of the chamber (24) is at least partially filled with a liquid (30), and the elastically deformable chamber is deformed by the fluid pressure pulsations within said fuel distributor, wherein one part of the chamber (24) is filled with oil (30) and a remainder of the chamber (24) is filled with a gaseous medium at atmospheric pressure.

2. A flat pipe pressure damper (1) for damping fluid pressure pulsations in a tubular fuel distributor (6) of a fuel supply for a motor vehicle, comprising at least one elastically deformable chamber (24) within the fuel distributor (6) which is in operative connection with the fuel, a part of the chamber (24) is at least partially filled with a liquid (30), and the elastically deformable chamber is deformed by the fluid pressure pulsations within said fuel distributor, in which from about 88% to about 92% of a volume of the chamber (24) is filled with oil (30).

3. A flat pipe pressure damper (1) for damping fluid pressure pulsations in a tubular fuel distributor (6) of a fuel supply for a motor vehicle, comprising at least one elastically deformable chamber (24) within the fuel distributor (6) which is in operative connection with the fuel, a part of the chamber (24) is at least partially filled with a liquid (30), and the elastically deformable chamber is deformed by the fluid pressure pulsations within said fuel distributor, in which the flat pipe (18) is comprised of plate steel, and which contains at least one flat pipe pressure damper (1).

4. A fuel supply line as set forth in claim 1, in which the gaseous medium is air.

5. The flat pipe pressure damper according to claim 1, wherein the chamber (24) is completely encompassed by the fluid in the fuel distributor and is embodied as an at least partially thin-walled flat pipe (18), a cross-section of the flat pipe is small in relation to a longitudinal span and includes ends (20) that are closed.

6. The flat pipe pressure damper according to claim 2, wherein the chamber (24) is completely encompassed by the fluid in the fuel distributor and is embodied as an at least partially thin-walled flat pipe (18), a cross-section of the flat pipe is small in relation to a longitudinal span and includes ends (20) that are closed.

7. The flat pipe pressure damper according to claim 1, In which from about 88% to about 92% of a volume of the chamber (24) is filled with oil (30).

8. The flat pipe pressure damper according to claim 5, in which from about 88% to about 92% of a volume of the chamber (24) is filled with oil (30).

9. The flat pipe pressure damper according to claim 1, in which the flat pipe (18) is comprised of plate steel.

10. The flat pipe pressure damper according to claim 5, in which the flat pipe (18) is comprised of plate steel.

11. The flat pipe pressure damper according to claim 2, in which the flat pipe (18) is comprised of plate steel.

12. A fuel supply line (6) according to claim 1, which contains at least one flat pipe pressure damper (1).

13. A fuel supply line (6) according to claim 2, which contains at least one flat pipe pressure damper (1).

* * * * *